US006811053B2

(12) United States Patent
Schwarzli

(10) Patent No.: US 6,811,053 B2
(45) Date of Patent: Nov. 2, 2004

(54) APPARATUS FOR DISPENSING FLAT ARTICLES

(75) Inventor: Josef W. Schwarzli, Stouffville (CA)

(73) Assignee: Beaver Machine Corporation, Newmarket (CA)

( * ) Notice: Subject to any disclaimer, the term of this patent is extended or adjusted under 35 U.S.C. 154(b) by 83 days.

(21) Appl. No.: 10/283,274

(22) Filed: Oct. 30, 2002

(65) Prior Publication Data

US 2003/0173375 A1 Sep. 18, 2003

(30) Foreign Application Priority Data

Mar. 15, 2002 (CA) ..... 2376928

(51) Int. Cl.[7] ..... B65H 7/18

(52) U.S. Cl. ..... 221/20; 221/124; 221/195; 221/275

(58) Field of Search ..... 221/20, 124, 191, 221/270, 272, 275, 195

(56) References Cited

U.S. PATENT DOCUMENTS 2,696,324 A * 12/1954 Jones ..... 221/20
2,876,928 A * 3/1959 Adams et al. ..... 221/122
2,990,084 A * 6/1961 Probasco ..... 221/122
3,432,074 A * 3/1969 Brown ..... 221/117
4,109,825 A * 8/1978 Weitzman ..... 221/14
4,534,492 A 8/1985 Schwarzli ..... 221/203
D282,857 S 3/1986 Schwarzli ..... D20/7
4,759,468 A * 7/1988 Hoffman ..... 221/20
5,176,290 A 1/1993 Schwarzli ..... 221/203
5,259,532 A 11/1993 Schwarzli ..... 221/304

* cited by examiner

*Primary Examiner*—David H. Bollinger
(74) *Attorney, Agent, or Firm*—Dimock Stratton LLP; Mark B. Eisen

(57) ABSTRACT

An apparatus for dispensing flat articles, which is entirely mechanical, resistant to theft and vandalism and consistently dispenses the correct volume of merchandize. A dispensing mechanism locks out a patron as the last article or item of merchandize is dispensed from the merchandize magazine by arresting rotation of the coin mechanism at a point where a coin cannot be inserted. A novel locking mechanism for the door covering the secure compartment in which collected coins are stored and a novel protective flap for the dispensing slot are also provided.

9 Claims, 6 Drawing Sheets

APPARATUS FOR DISPENSING FLAT ARTICLES

FIELD OF THE INVENTION

This invention relates to vending machines. In particular, this invention relates to an apparatus for dispensing flat articles.

BACKGROUND OF THE INVENTION

Vending machines have been designed to dispense many different kinds of merchandise. Such machines provide a dispensing mechanism which dispenses a preset amount of merchandise responsive to the insertion of one or more coins of the required denomination into a coin mechanism.

These types of vending machines can be designed to dispense virtually any kind of merchandise, however there are limitations based on the location of the machine and the type of merchandise sought to be vended. The type of merchandise will often determine the type of dispensing mechanism used. For example, a dispensing mechanism suitable for dispensing hard, round gum balls is unlikely to be suitable for dispensing softer, rectangular confectionaries such as chocolate bars. Each type of merchandise presents its own parameters in terms of what dispensing mechanism will operate effectively, i.e. consistently dispensing the correct volume of merchandise so that neither the patron nor the operator loses money, without damaging the merchandise. Flat articles, such as flat packages, for example sports cards, stickers etc., present unique problems in this regard.

Another important factor is the location of the vending machine. In many locations in which vending machines are likely to be placed, there is no power supply (such as a wall plug or floor monument) available to power electrically-powered devices such as motors or solenoids. Therefore, to be adaptable for use in any location, a vending machine must be able to operate entirely mechanically, without requiring any electrically-powered components.

Also, such vending machines are typically designed to be used in unsupervised areas. Accordingly, they must be resistant to theft and vandalism.

SUMMARY OF THE INVENTION

The present invention addresses these and other problems. The invention provides an apparatus for dispensing flat articles, such as merchandise made or packaged in the form of a flat pack, which is entirely mechanical, resistant to theft and vandalism and consistently dispenses the correct volume of merchandise.

The invention accomplishes this by providing a dispensing mechanism actuated by a manually rotated coin mechanism, which locks out a patron as the last article or item of merchandise is dispensed from the merchandise magazine, by arresting rotation of the coin mechanism at a point where a coin cannot be inserted. This also provides an immediate visual indication to service personnel that the merchandise magazine is empty.

The invention further provides a novel locking mechanism for the door covering the secure compartment in which collected coins are stored, which reduces opportunities for theft; and a novel protective flap for the dispensing slot through which merchandise is dispensed, which prevents insertion of a tool or the spraying of water into the merchandise area, which reduces opportunities for theft and vandalism and renders the vending machine more resistant to adverse weather conditions in outdoor installations.

BRIEF DESCRIPTION OF THE DRAWINGS

In drawings which illustrate by way of example only a preferred embodiment of the invention.

DETAILED DESCRIPTION OF THE INVENTION

Figure 1:
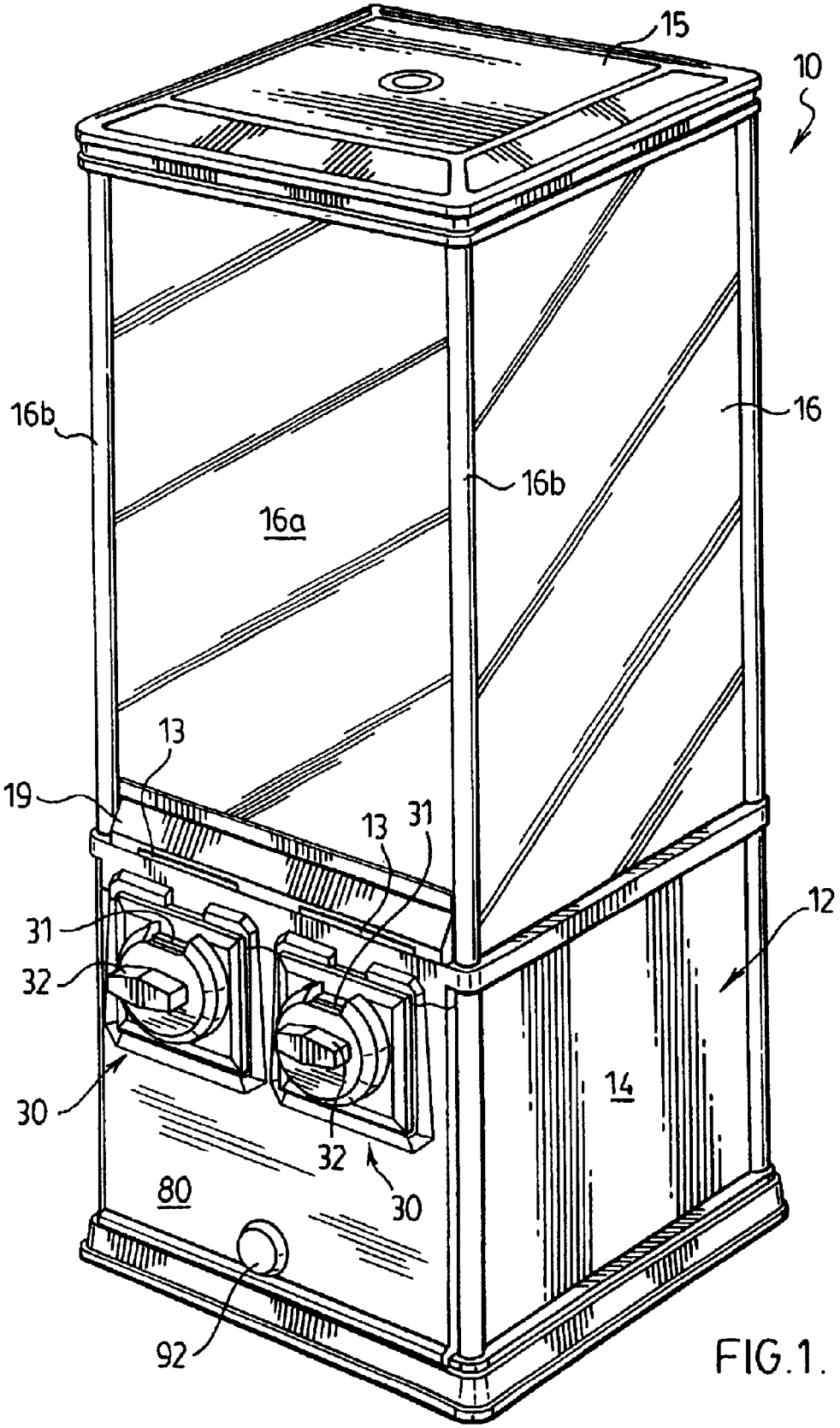
FIG. 1 is a perspective view of an apparatus according to the invention.

FIG. 1 illustrates an apparatus 10 according to the invention. A housing 12 defines a secure compartment 14 disposed beneath a merchandise compartment 16 of the housing 12. The merchandise compartment 16 is preferably separated from the secure compartment 14 by a floor 18, so that service personnel charged with replenishing the merchandise can open the merchandise compartment 16 but do not have access to the collected coins stored in the secure compartment 14.

Figure 2:
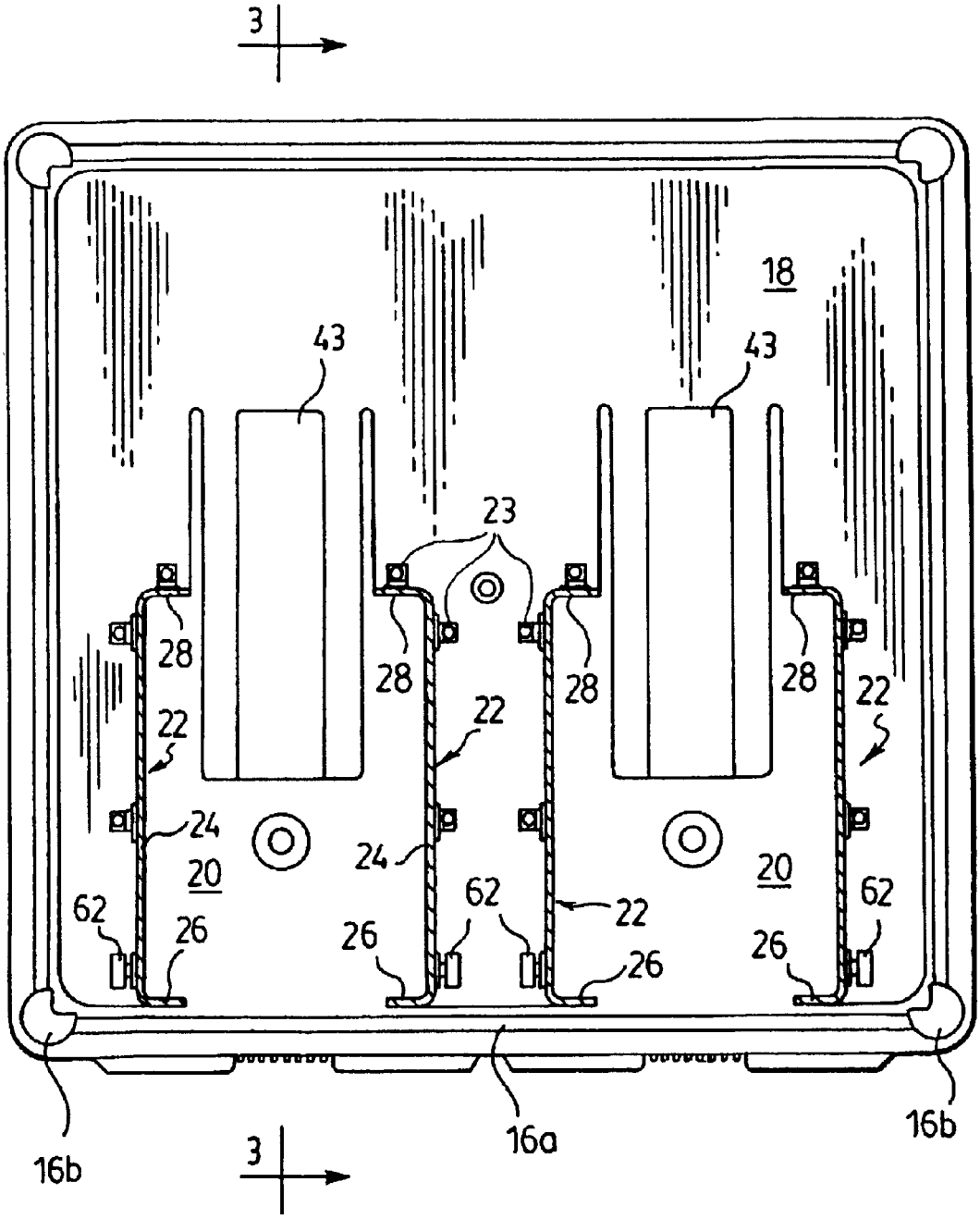
FIG. 2 is a top plan view of the merchandise compartment.

The merchandise compartment 16 houses at least one merchandise magazine 20, shown in FIG. 2. There are two merchandise magazines 20 in the embodiment shown, so that the apparatus 10 can stock two different types of merchandise at the same time. However, there is no limit to the number of merchandise magazines 20 which the apparatus 10 may contain. Each merchandise magazine 20 preferably comprises a pair of opposed wall portions 22, for example formed from sheet metal, having side walls 24 and partial front and rear walls 26, 28, with a space between the front walls 26 and the rear walls 28 that allows service personnel to more easily manipulate the merchandise into the magazine 20 when replenishing the stock, and to more easily remove the merchandise from the magazine 20 when changing the stock. The latter can also be facilitated by a lifting arm (not shown), for example a "U"-shaped member hanging transversely from the floor 18 within each magazine 20 near the front or the rear, having heads seated in recesses so as not to protrude above the level of the floor 18, which when depressed upwardly lifts up any articles remaining in the magazine 20 so they can be more easily grasped for removal.

The wall portions 22 may be anchored to the floor 18 in any convenient fashion, for example by tabs 23 which may be screwed or bolted to bosses (not shown) that preferably are spaced slightly lower from tabs 23, so that bolting the tabs 23 to the bosses draws the wall portions 22 tightly against the floor 18 to maintain a proper, stable alignment without rocking.

Figure 3:
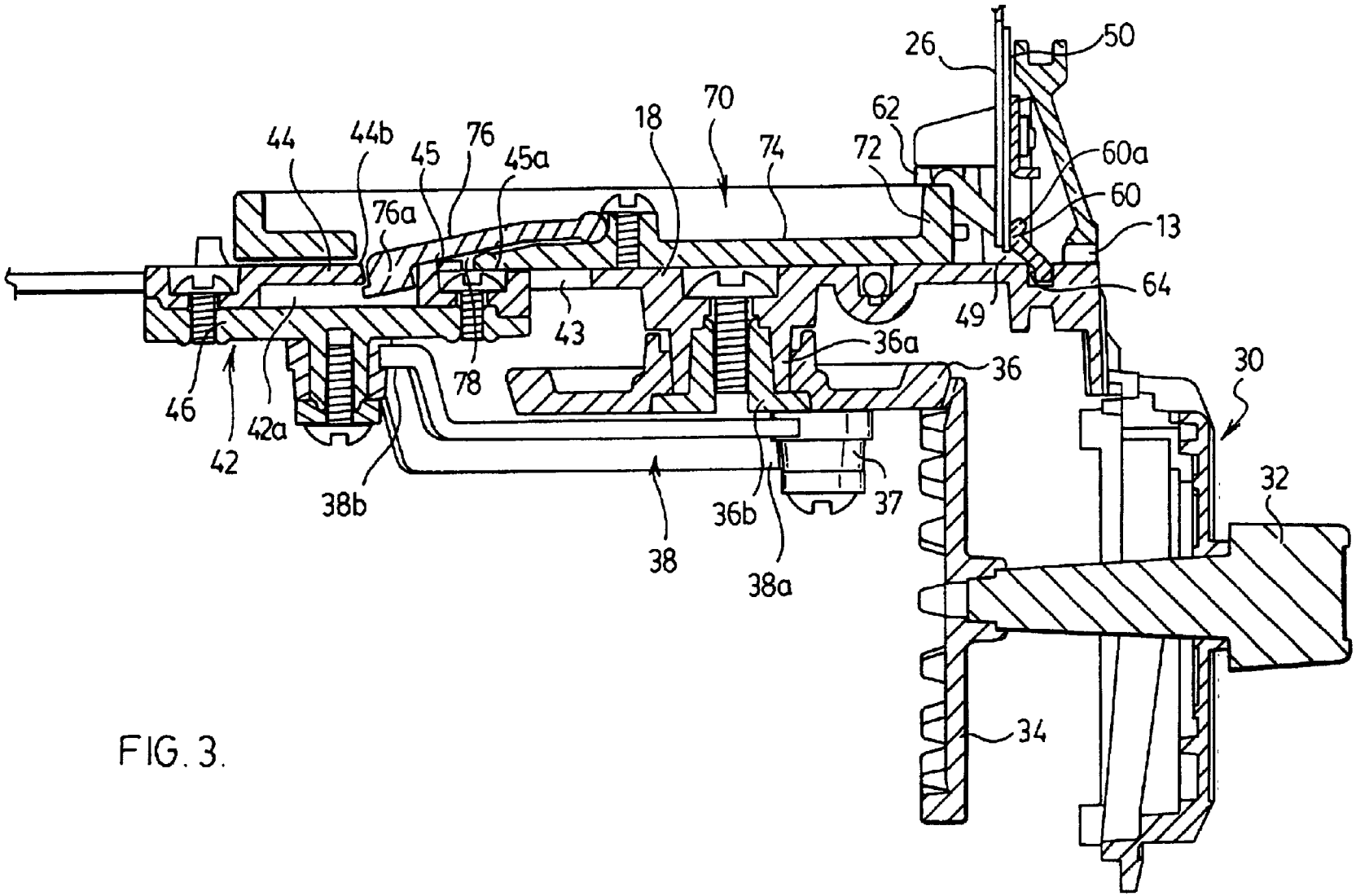
FIG. 3 is a cross-sectional elevation taken along the centre of one merchandise magazine.
Figure 4:
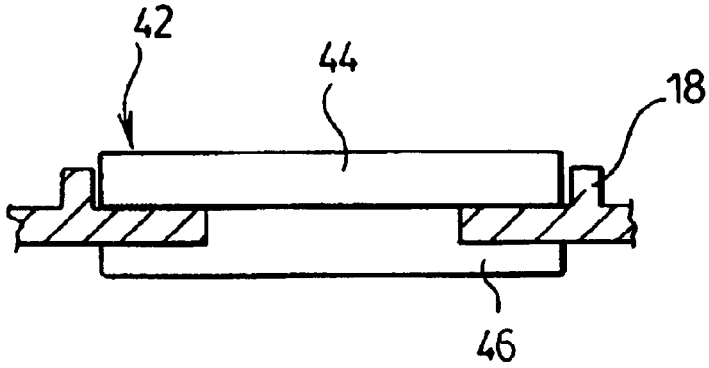
FIG. 4 is a front elevation of the slide.

Each merchandise magazine 20 is associated with a dispensing mechanism 40 actuated responsive to the rotation of a coin mechanism 30, shown in FIG. 3 (the dispensing mechanism 40 has been omitted from FIG. 2 for clarity). The coin mechanism 30 has a handle 32 operatively engaged to a drive gear 34 such that rotation of the handle 32 rotates the drive gear 34. Various mechanisms and devices may be provided within the coin mechanism 30 to ensure that the handle 32 can only be rotated when the correct denomination of coinage has been inserted into the mechanism 30. Suitable coin mechanisms 30 are described in U.S. Pat. No. 5,954,181 to Schwarzli issued Sep. 21, 1999, and in U.S. Pat. No. 5,950,793 to Schwarzli issued Sep. 14, 1999, both of which are incorporated herein by reference. The construction and operation of these coin mechanisms is fully detailed in the aforesaid patents; however, these coin mechanisms are referred to solely as examples of suitable coin mechanisms, and the invention is in no way limited to any particular coin mechanism 30.

The coin mechanisms 30 are mounted in a door 80, illustrated in FIG. 7, which is described in greater detail below. Each coin mechanism 30 is mounted so that its drive gear 34 is positioned to mesh with a crankshaft gear 36, as shown in FIG. 3, which operates the dispensing mechanism 40.

The dispensing mechanism 40 is illustrated in FIG. 3. The crankshaft gear 36 is rotatably mounted to the floor 18 in any convenient fashion, for example on a shaft 36*a* projecting from the floor 18 and held in position by a bushing 36*b*. In the embodiment shown, the crankshaft gear 36 is oriented substantially orthogonally to and meshing with the drive gear 34, and thus the drive and crankshaft gears 34, 36 may conveniently be bevel gears. Pivotably mounted to crankshaft gear 36 is a connecting rod 38, mounted to the crankshaft 37 and thus eccentrically relative to the axis of the crankshaft gear 36, so that the end 38*a* follows an orbital rotation about the axis of the crankshaft gear 36. The other end 38*b* of the connecting rod 38 is affixed in any suitable fashion to a slide 42. Thus, as the crankshaft gear 36 rotates, the orbital motion of the crankshaft 36*a* drives the connecting rod 38 which in turn causes the slide 42 to reciprocate.

Figure 5:
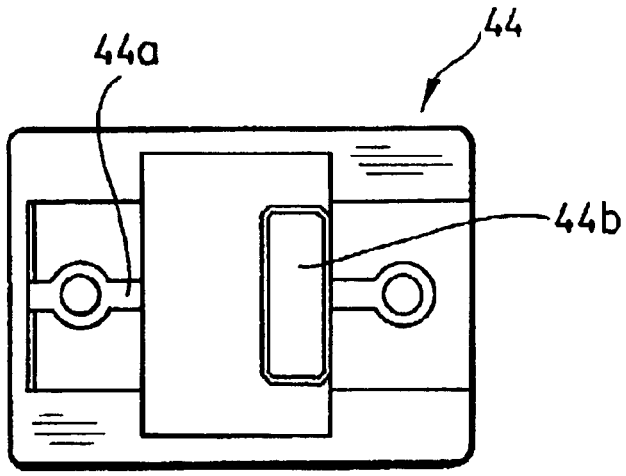
FIG. 5 is a bottom plan view of the top half of the slide.
Figure 6:
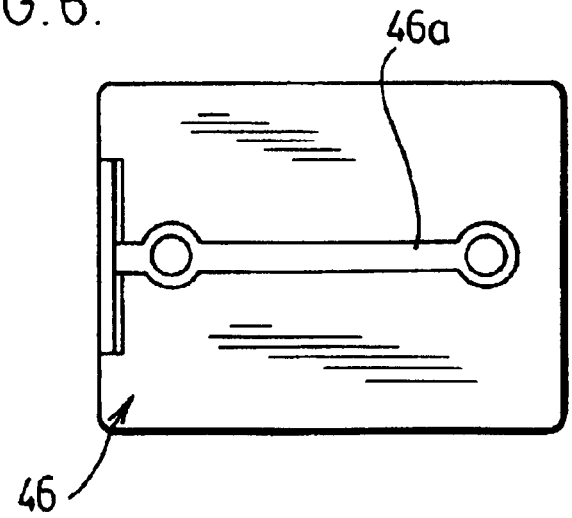
FIG. 6 is a top plan view of the bottom half of the slide.

The slide 42 is trapped in a track so that its movement is generally restricted to a front-to-back motion. For example, the slide 42 may comprise top and bottom halves 44, 46, shown in FIGS. 5 and 6, which when bolted together form a projection 44*a*, 46*a* which extends through a slot 43 in the floor 18 to constrain movement of the slide 42. The top half 44 of the slide 42 has an opening 44*b* which leads to a hollow 42*a* (seen in FIG. 3) for locking the slide 42 in a forward position when the magazine 20 is emptied, as is described in detail below. The top half 44 of the slide 42 also has a forward edge 45, which contacts the flat article of merchandise at the bottom of the stack of articles (not shown) in the magazine 20 and pushes the article out of the magazine 20 as the slide 42 moves forward during a rotational cycle of the coin mechanism 30.

The front walls 26 of the magazine 20 are thus raised above the floor 18, to allow an article of maximum thickness to be pushed out of the magazine 20 through space 49. Affixed to the front walls 26 is a stripper plate 50, which is preferably bolted through a vertical slot so that the height of the stripper plate 50 can be adjusted as required to size the space 49 exactly to the thickness of the article being dispensed from the magazine 20. Thus, only the bottom article is pushed through space 49 and out of the housing 12 through slot 13, while the stripper plate 50 prevents articles above the bottom article from being pushed out of the magazine 20.

In the preferred embodiment the front panel 16*a* of the merchandise compartment 16 is slidably disposed in frame members 16*b*, so it can be removed by removing the lid 15 to allow easy access to the magazines 20 for restocking purposes. The panel 16*a* seats in a threshold bar 19 containing slots 13, the slots 13 being aligned with the spaces 49 at the bottom-front of each respective magazine. This has the advantage that the slots 13 can be formed only to the height required for the thickness of the particular article being dispensed, to reduce opportunities for tampering with the inside of the apparatus 10, and if the article is changed to a thicker article so that higher slots 13 are required, only the threshold bar 19 needs to be changed. This also provides very structurally secure walls for the slots 13, so that the slots 13 are less prone to deformation by a prying tool.

The invention further provides a security flap 60 pivotally mounted, for example on brackets 62, so as to move between a closed position in which the flap 60 rests against the floor 18, and an open position in which the space 49 is exposed to the slot 13 so that an article can be dispensed from the apparatus 10. The free end of the flap 60 preferably rests in a groove 64 formed in the floor 18, to resist prying of the flap 60 to the open position by a flat tool such as a knife, and deflect the tool upward along the flap 60. The flap 60 also preferably has a longitudinal ridge 60*a* which serves both to block the tool from striking the stripper plate 50 (which is preferably formed from spring steel and is subject to deformation), and to redirect any water spraying into the slot 13 (for example from rain splatter or a water gun) into the groove, to be drained away from the merchandise.

The invention provides a locking mechanism for locking the slide 42 in a forward position when the magazine 20 is emptied. A weight 70, shown in FIG. 3, is placed over the stack of articles when the magazine 20 is loaded, to keep the bottom article flat and facilitate proper dispensing as the stock depletes. The weight 70 comprises a body 72 having a floor 74. A finger 76 is pivotally mounted on the floor 74 such that in its lowermost position the finger 76 extends through an opening 78 in the floor 74 of the weight 70. The finger 76 has a hook 76*a* adapted to extend into the opening 44*b* in the top half 4 of the slide 42 and rest in the hollow 42*a*, to lock the slide 42 in a forward position, as described below.

Figure 7:
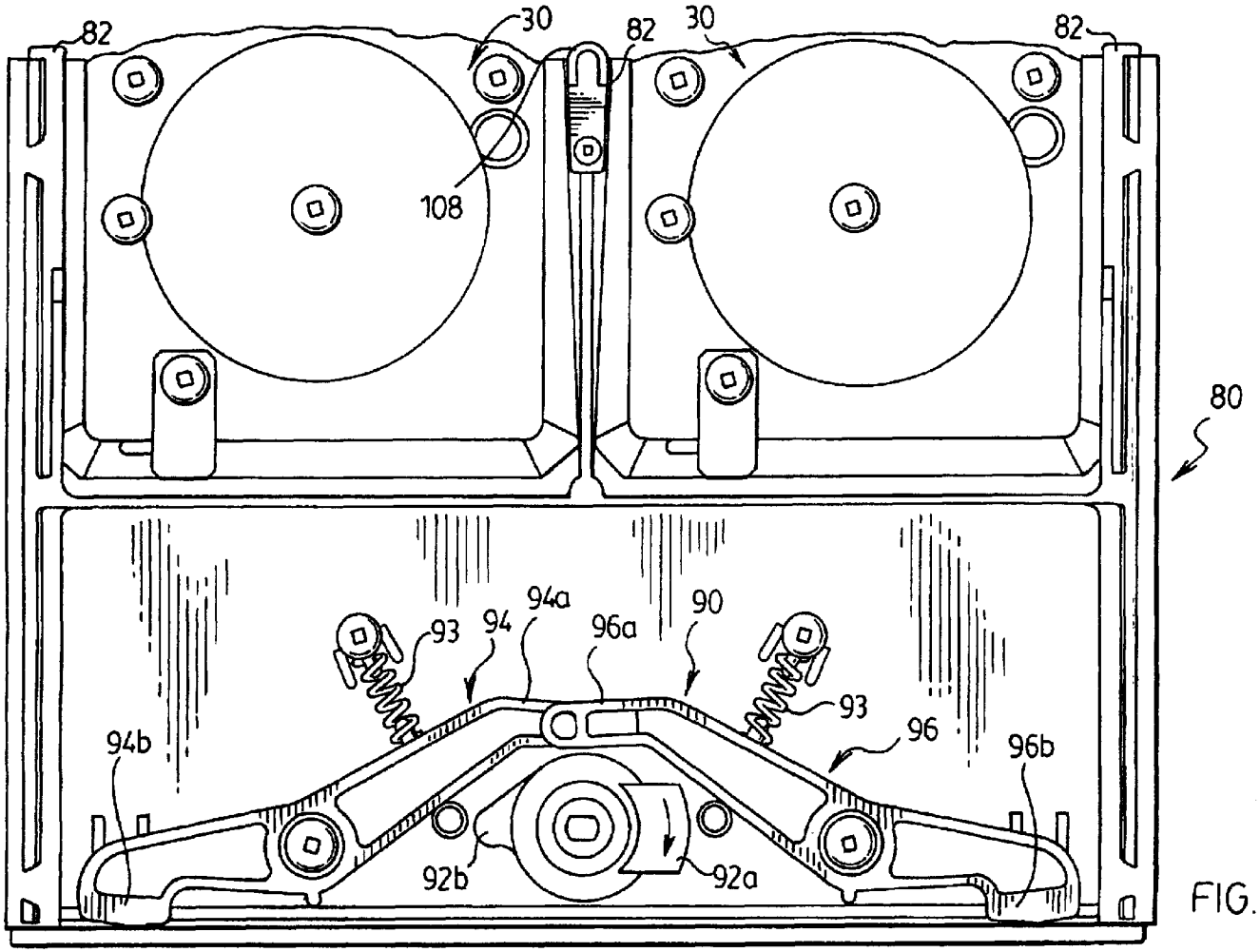
FIG. 7 is a rear elevation of the door to the secure compartment.

The interior or rear face of the door 80 to the secure compartment 14 is illustrated in FIG. 7. The coin mechanisms 30 are mounted in the upper portion of the door 80, as described above. The door 80 is mounted to the secure compartment 14 by a plurality of tabs 82 which mate with corresponding grooves (not shown) in the underside of the floor 18 adjacent to the front edge of the floor 18, and is locked in position by a door locking mechanism 90 provided in a lower portion of the door 80. The door locking mechanism 90 comprises a lock 92, for example a conventional rotary lock, and rockers 94, 96. The rockers 94, 96 are pivotally mounted to the door 80 and respectively comprise a cam arm 94*a*, 96*a* and a latch 94*b*, 96*b*. The cam arms 94*a*, 96*a* are biased to the open position shown in FIG. 7, for example by compression springs 93 or in any other suitable fashion. The lock 92 has a latch 92*a* adapted to engage a complimentary groove (not shown) formed in the base of the housing 12, and a cam 92*b* which, when the lock 82 is rotated to the locked position, forces the cam arms 94*a*, 96*a* toward the locked position in which latches 94*b*, 96*b* respectively engage complimentary grooves (not shown) formed in the base of the housing 12. The locking mechanism 90 thus provides a very secure three-point latching engagement with a single rotation of the lock 92.

Figure 8:
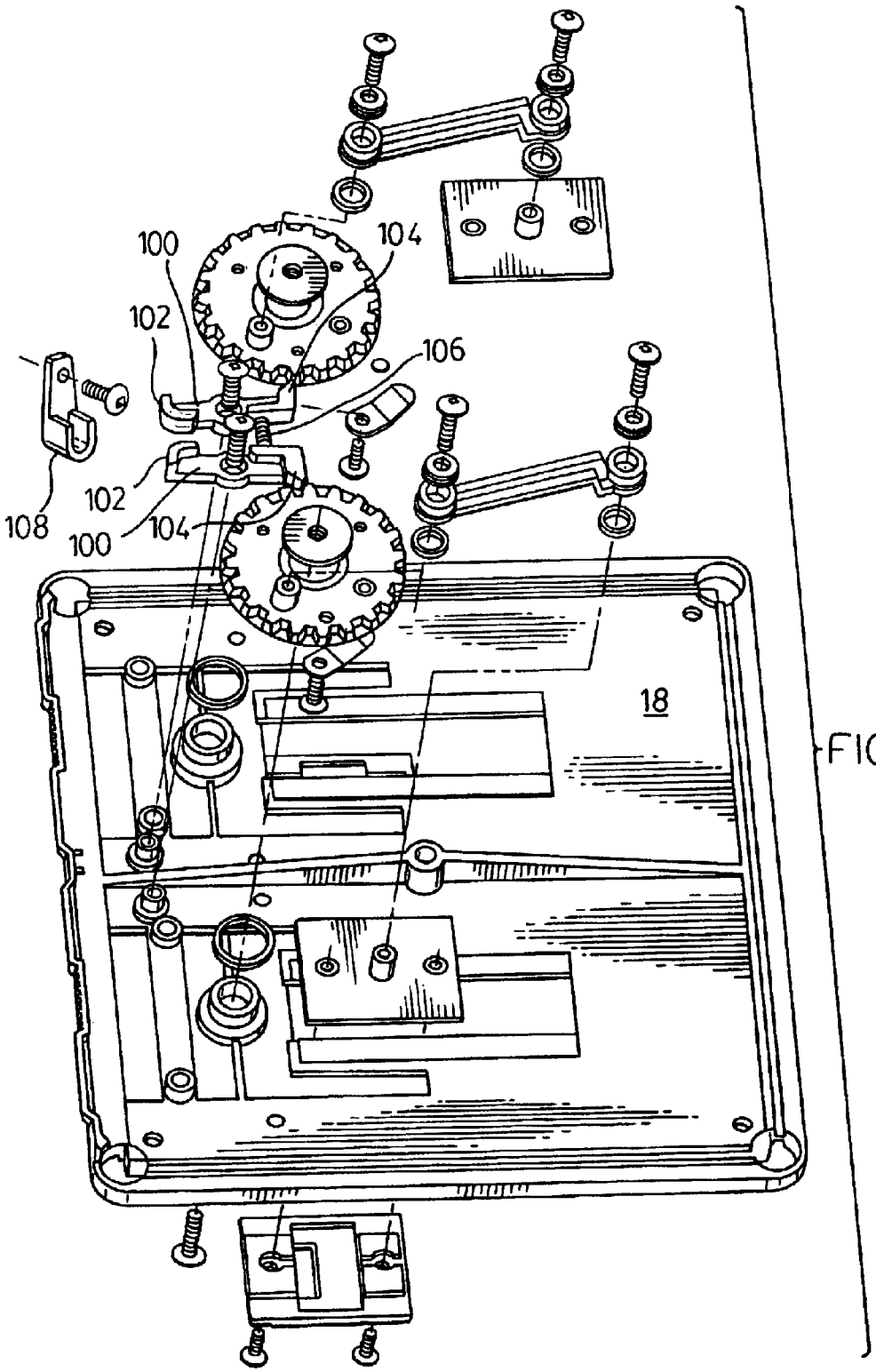
FIG. 8 is an exploded perspective view of the underside of the floor of the merchandise compartment.

In operation, a cash box (not shown) is placed in the secure compartment 14 beneath each coin mechanism 30. The dispensing mechanisms 40 are rotated to the starting position, with the slides 42 at the forward-most position in their path of travel, to ensure that the drive gear 34 properly lines up with the crankshaft gear 36 with both the coin mechanisms 30 and the slides in the starting position. This can be achieved, for example, by a pair of levers 100 (shown in FIG. 8) that are spring-biased toward the drive gears 34 and actuated by a cam 108 affixed to the door 80, which blocks the space between the tail ends 102 of the levers 100 so that when the door 80 is opened, the tail ends 102 move together and the tips 104 at the opposite ends of the levers 100 thus engage into the teeth of the drive gears 34. The mechanism cannot move while the levers 100 are in this position. When the door 80 is closed, the cam 108 spreads the tail ends 102 of the levers 100 and retracts the tips 104 from the drive gears 34.

Once the dispensing mechanisms 40 are in the starting position, the tabs 82 of the door 80 are inserted into their complimentary slots (not shown) in the floor 18 and the bottom of the door 80 is swung into a closed position. The lock 92 is rotated to engage the latches 92*a*, 94*b*, 96*b* in their complimentary slots (not shown) in the base of the apparatus 10, to secure the secure compartment 14.

The magazines 20 are loaded with stacks of articles to be vended, and a weight 70 is placed on top of each stack of articles. The hooked end 76*a* of the finger 76 rests on top of the uppermost article in the stack of merchandise. The front panel 16 is slid into position and the lid 15 is locked to the housing in conventional fashion to close the merchandise compartment 16. The apparatus 10 is now ready for vending. All coin mechanisms 30 and dispensing mechanisms 40 are in the starting position, with the coin slots 31 fully accessible and the slides 42 at the forward-most position in each magazine 20.

A patron deposits the required denomination of one or more coins (or tokens, checks or otherwise) into the coin slot 31, to operate the coin mechanism 30 that corresponds to the magazine containing the articles sought to be purchased, for example as indicated by signage on the front panel 16*a* of the merchandise compartment 16. The patron rotates the handle 32, which rotates the drive gear 34, which in turn rotates the crankshaft gear 36. The crankshaft 37 revolves to the rear, driving the connecting rod 38 with it, and thus driving the slide 42 to the engaging position, at or near the rear of its path of travel within the slot 43.

As the edge 45 moves beyond the edge of the article, the article falls onto ledge 45*a*. As the crankshaft 37 revolves past the engaging position and starts moving toward the front, the connecting rod 38 draws the slide 42 toward the front, pushing the article out of the magazine 20 through space 49. The leading edge of the article contacts the security flap 60 and raises it to the open position, and the article continues to be pushed by the edge 45 of the slide 42 until it protrudes from the slot 13 sufficiently for the patron to grasp and remover the article. At this point the slide 42 has returned to the starting position at the forward-most point in its path of travel, the coin mechanism 30 has returned to the starting position with the coin slot 31 accessible to a coin, and the apparatus is ready for another dispensing cycle.

As the last article in a magazine 20 is dispensed, the hooked end 76*a* of the finger 76 drops into the opening 44*b* in the top half 44 of the slide 42, and rests partially in the hollow 42*a*, as shown in FIG. 3. The slide 42 is thus blocked from moving along its path of travel, which locks the connecting rod 38 and thus the crankshaft gear 36, which in turn locks the drive gear 34. The coin mechanism 30 can therefore no longer be rotated. This occurs just before the slide 42 reaches the forward-most point in its path of travel, as the coin slot 31 is becoming exposed but before the coin slot 31 has become fully accessible. Therefore, a patron cannot insert another coin into the coin mechanism. Further, service personnel arriving to service the apparatus have an immediate visual indication that the corresponding merchandise magazine 20 is empty, because the coin slot 31 is out of the starting position.

To restock the magazine, service personnel removes the lid 15, removes the front panel 16*a* and removes the weight 70 from the magazine 20. The service person inserts a new stack of articles into the magazine 20, adjusting the height of the stripper plate 50 if necessary to accommodate any change in thickness of the articles, and places the weight 70 on top of the new stack of articles. The front panel 16*a* is replaced and the lid 15 is closed and locked. If the service personnel also has access to the secure compartment 14, it can be opened by rotating the lock 92 to the unlocked position, which retracts the latches 92*a*, 94*b* and 96*b* from the base of the housing 12, and the door 80 can be swung out and removed. The coins in the cash box(es) are collected, and the door 80 is replaced in the manner described above.

Various embodiments of the present invention having been thus described in detail by way of example, it will be apparent to those skilled in the art that variations and modifications may be made without departing from the invention. The invention includes all such variations and modifications as fall within the scope of the appended claims.

I claim:

1. An apparatus for dispensing flat articles, comprising a merchandise compartment containing a magazine for storing a stack of articles, having a front wall raised from a floor of the merchandise compartment forming a space through which only a bottom article in the stack of articles can pass, a coin mechanism having a drive gear rotatable by a handle through a rotational cycle, a dispensing mechanism comprising a slide, and a crankshaft gear having a crankshaft coupled to the slide, coupled to the drive gear such that rotation of the drive gear moves the slide between an engaging position in which the slide engages the bottom article and a starting position forward of the engaging position, whereby rotation of the handle through the rotational cycle moves the slide from the starting position to the engaging position to engage the bottom article and back to the starting position to push the bottom article out of the space, and a weight disposed on top of the stack of articles having a movable finger, whereby as the last article in the magazine is dispensed the finger engages the slide to lock the slide in a preset locked position and prevent rotation of the coin mechanism, wherein the preset locked position is before the starting position of the coin mechanism such that a coin slot in the coin mechanism will not accept a coin.

2. The apparatus of claim 1 comprising a plurality of magazines, each having an associated coin mechanism and dispensing mechanism.

3. An apparatus for dispensing flat articles, comprising merchandise compartment containing a magazine for storing a stack of articles, having a front wall raised from a floor of the merchandise compartment forming a space through which only a bottom article in the stack of articles can pass, a coin mechanism having a drive gear rotatable by a handle through a rotational cycle, a dispensing mechanism comprising a slide, and a crankshaft gear coupled to the drive gear having a crankshaft coupled to the slide, such that rotation of the drive gear moves the slide between an engaging position in which the slide engages the bottom article and a starting position forward of the engaging position, whereby rotation of the handle through the rotational cycle moves the slide from the starting position to the engaging position to engage the bottom article and back to the starting position to push the bottom article out of the space, and a flap disposed in front of the space, pivotable from a closed position against the floor of the merchandise compartment to an open position exposing the space to an exterior of the apparatus, whereby pushing the bottom article out of the space raises the flap from the closed position to the open position.

4. The apparatus of claim 3 in which the flap rests in a groove along the floor.

5. The apparatus of claim 3 in which the flap is provided with a longitudinal ridge, to block a tool from being forced to the front wall of the magazine.

6. The apparatus of claim 3 comprising a plurality of magazines, each having an associated coin mechanism and dispensing mechanism.

7. An apparatus for dispensing flat articles, comprising merchandise compartment containing a magazine for storing a stack of articles, having a front wall raised from a floor of the merchandise compartment forming a space through which only a bottom article in the stack of articles can pass, a coin mechanism having a drive gear rotatable by a handle through a rotational cycle, a dispensing mechanism comprising a slide, and a crankshaft gear coupled to the drive gear having a crankshaft coupled to the slide, such that rotation of the drive gear moves the slide between an engaging position in which the slide engages the bottom article and a starting position forward of the engaging position, whereby rotation of the handle through the rotational cycle moves the slide from the starting position to the engaging position to engage the bottom article and back to the starting position to push the bottom article out of the space, and a removable threshold bar having a slot disposed in alignment with the space.

8. The apparatus of claim 7 in which the threshold bar comprises a groove along a top edge into which a front panel of the merchandise compartment seats.

9. The apparatus of claim 7 comprising a plurality of magazines, each having an associated coin mechanism and dispensing mechanism and slot.

* * * * *